US007699756B2

(12) United States Patent
Piane, Jr.

(10) Patent No.: US 7,699,756 B2
(45) Date of Patent: Apr. 20, 2010

(54) ARRANGEMENT FOR ATTACHING AN EXERCISE DEVICE TO A LADDER-LIKE FRAME OF AN EXERCISE MACHINE

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 0 days.

(21) Appl. No.: 12/291,625

(22) Filed: Nov. 12, 2008

(65) Prior Publication Data

US 2009/0072111 A1 Mar. 19, 2009

Related U.S. Application Data

(63) Continuation-in-part of application No. 11/439,081, filed on May 23, 2006.

(60) Provisional application No. 60/999,927, filed on Nov. 23, 2007.

(51) Int. Cl.
*A63B 21/00* (2006.01)
*A63B 21/068* (2006.01)
*A63B 17/00* (2006.01)

(52) U.S. Cl. ..... 482/38; 482/36; 482/42; 482/92; 482/95; 482/104; 482/908; 248/222.52

(58) Field of Classification Search ..... 482/17, 482/36–42, 95, 96, 104, 142, 148, 904, 908; 403/106, 108, 348, 353; 248/125.3, 220.31, 248/220.43, 221.11, 222.52
See application file for complete search history.

(56) References Cited

U.S. PATENT DOCUMENTS

| | | | | |
|---|---|---|---|---|
| 323,792 | A * | 8/1885 | Coop et al. | 482/102 |
| 4,262,901 | A * | 4/1981 | Faust | 482/104 |
| 4,492,375 | A * | 1/1985 | Connelly | 482/138 |
| 4,561,651 | A * | 12/1985 | Hole | 482/104 |
| 4,620,701 | A * | 11/1986 | Mojden | 482/41 |
| 4,907,798 | A | 3/1990 | Burchatz | |
| 5,346,448 | A * | 9/1994 | Sollo | 482/104 |
| 5,727,764 | A * | 3/1998 | Angeles | 248/295.11 |
| D444,827 | S * | 7/2001 | Mobley | D21/694 |
| 6,422,523 | B1 * | 7/2002 | Weshler | 248/222.52 |
| 6,641,510 | B2 * | 11/2003 | Koenig | 482/104 |
| 6,746,379 | B1 * | 6/2004 | Brawner | 482/104 |
| 7,338,416 | B2 * | 3/2008 | Smith | 482/104 |
| 2002/0153341 | A1 * | 10/2002 | May et al. | 211/192 |
| 2007/0032357 | A1 | 2/2007 | Piane, Jr. | |

FOREIGN PATENT DOCUMENTS

JP 05076620 A * 3/1993

* cited by examiner

*Primary Examiner*—Loan H Thanh
*Assistant Examiner*—Victor K Hwang
(74) *Attorney, Agent, or Firm*—Karl F. Milde, Jr.; Eckert Seamans Cherin & Mellott, LLC

(57) ABSTRACT

An apparatus for removably mounting an exercise apparatus to a supporting structure such as a ladder-like structure. Various types of mounting apparatus with specially designed brackets having multiple interchangeable parts, attachments and accessories, are used to facilitate easy and quick mounting of several types of exercise apparatus to the supporting structure.

6 Claims, 11 Drawing Sheets

ARRANGEMENT FOR ATTACHING AN EXERCISE DEVICE TO A LADDER-LIKE FRAME OF AN EXERCISE MACHINE

CROSS-REFERENCE TO RELATED APPLICATIONS

This application claims priority from Provisional Application No. 60/999,927 filed Nov. 23, 2007, and is a continuation-in-part of application Ser. No. 11/439,081 filed May 23, 2006, entitled "User-defined Exercise Apparatus" and published Feb. 8, 2007, under the Pub. No. 2007/0032357.

FIELD OF THE INVENTION

The present invention relates to the field of exercise apparatus and more specifically to mounting apparatuses for removable attachment of the exercise apparatus to a supporting structure.

BACKGROUND OF THE INVENTION

Existing exercise devices are either screwed/bolted or permanently joined with the frame structure, which eliminates the flexibility of the usage of the exercise devices at different positions. Moreover, once attached to the frame structure, it is cumbersome and time consuming method to remove the exercise devices from the framing structure. U.S. Pat. No. 4,907,798 discloses an exercise device screwed to a tubular support member. The exercise device fittings (attaching means) are removably attached to each end of the tubular support member of rectangular roof frame. Thus, for changing the position of the exercise device, a user has to unscrew it from the current position and screws it to the desired position. Sometimes unscrewing/screwing can be difficult due to jamming or problem in threading of the bolts. Also, assembling/disassembling of the exercise devices from the framing structure is time consuming.

The US patent application 2007/0032357A1 discloses a kit which can be assembled to form a user defined support structure. FIG. 1 illustrates one such arrangement of ladder-like structure 100 for the attachment of exercise devices. Ladder-like structure 100 comprises two vertical, elongate support members 110 spaced apart in parallel relationship and a plurality of horizontal rungs 120 extending between the support members 110 at substantially regular intervals. The elongate vertical support member 110 has a rectangular profile and a plurality of round holes therein, larger holes 45 and smaller holes 46, located at regular intervals along its length. The holes 45, 46 facilitate attachment of exercise devices to the support structure at any desired height.

FIG. 2 illustrates a supporting cell 300 assembled using the ladder-like structure 100 and thereby facilitating attachment of various types of exercise devices (200, 202 and 207). However, this arrangement limits attachment of the exercise devices 200 only to the ladder like structure 100 and not directly to any other supporting structures such as standard wall or the like. Thus, limiting the versatility of the room layouts for the user who may want the exercise devices to line the perimeter of the room, rather than be fixed to the ladder-like structure 100 that is usually located further out from the walls. So, there is a need to construct such attaching means which allows a user to either mount the attachments to the frame structure or to the per-perimeters of a room.

Also assembling/disassembling of the screwed/bolted exercise devices from the ladder like structure 100 or the standard wall is cumbersome and time consuming. Thus there is a need to design suitable mounting means which can facilitates exercise devices to be easily mounted/dismounted to the ladder like structure 100.

SUMMARY OF THE INVENTION

It is therefore a principal objective of the present invention to provide a mechanism for attaching an exercise device to a ladder-like structure which is easy, quick and simple to use.

This object, as well as other objects which will become apparent from the discussion that follows, are achieved, in accordance with the present invention, by providing an exercise device with a means of attachment of the type shown and described herein.

DETAILED DESCRIPTION OF THE DRAWINGS

Embodiments of the present invention provide several attaching means to easily and removably attach exercise devices to a framing structure or a wall. In the description of the present invention, numerous specific details are provided, such as examples of components and/or mechanisms, to provide a thorough understanding of the various embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Figure 1:
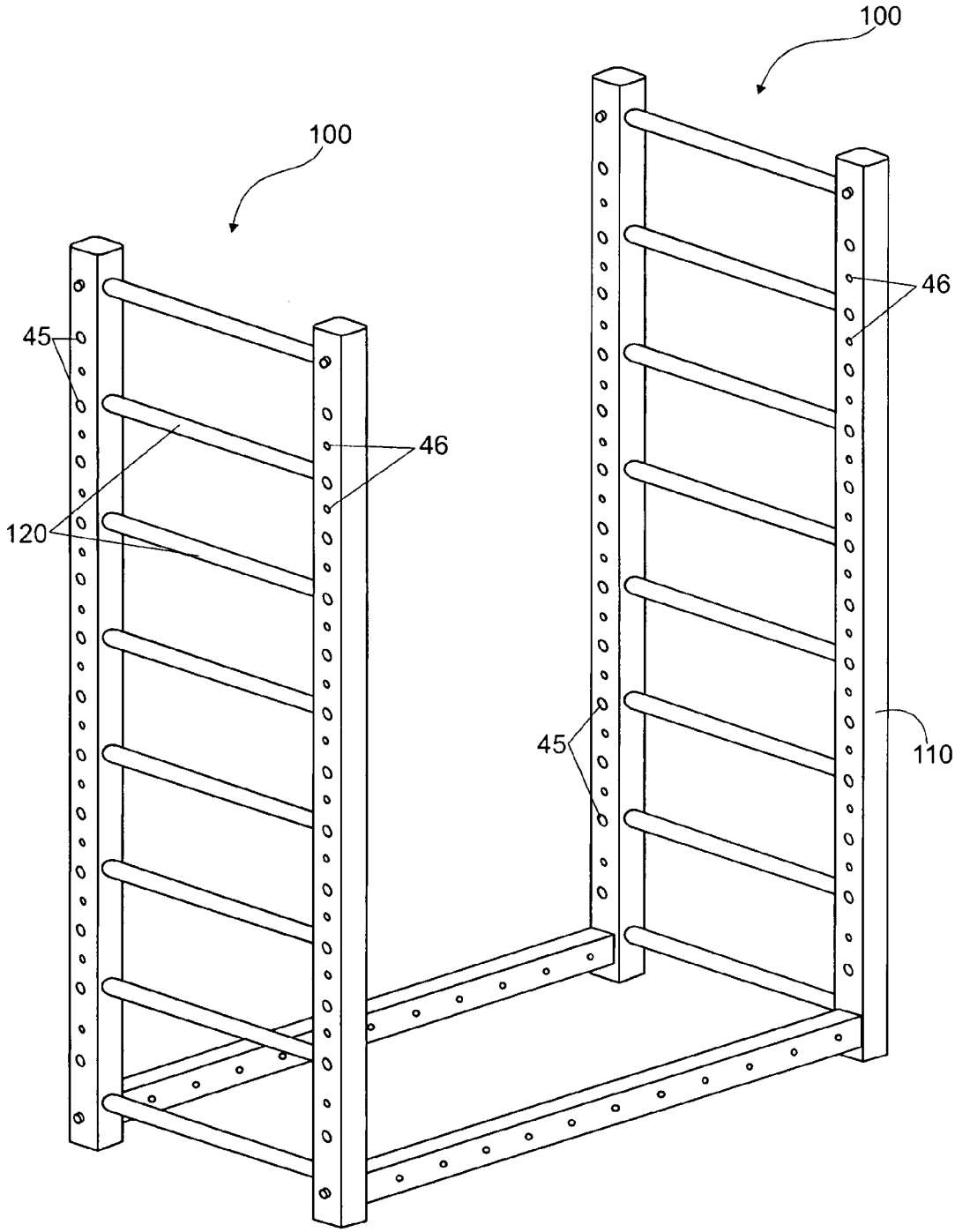
FIG.1 (PRIOR ART)
FIG. 1 (Prior Art) illustrates an arrangement of two ladder-like structures 100 to form a supporting frame for the attachment of exercise devices (not shown)
Figure 2:
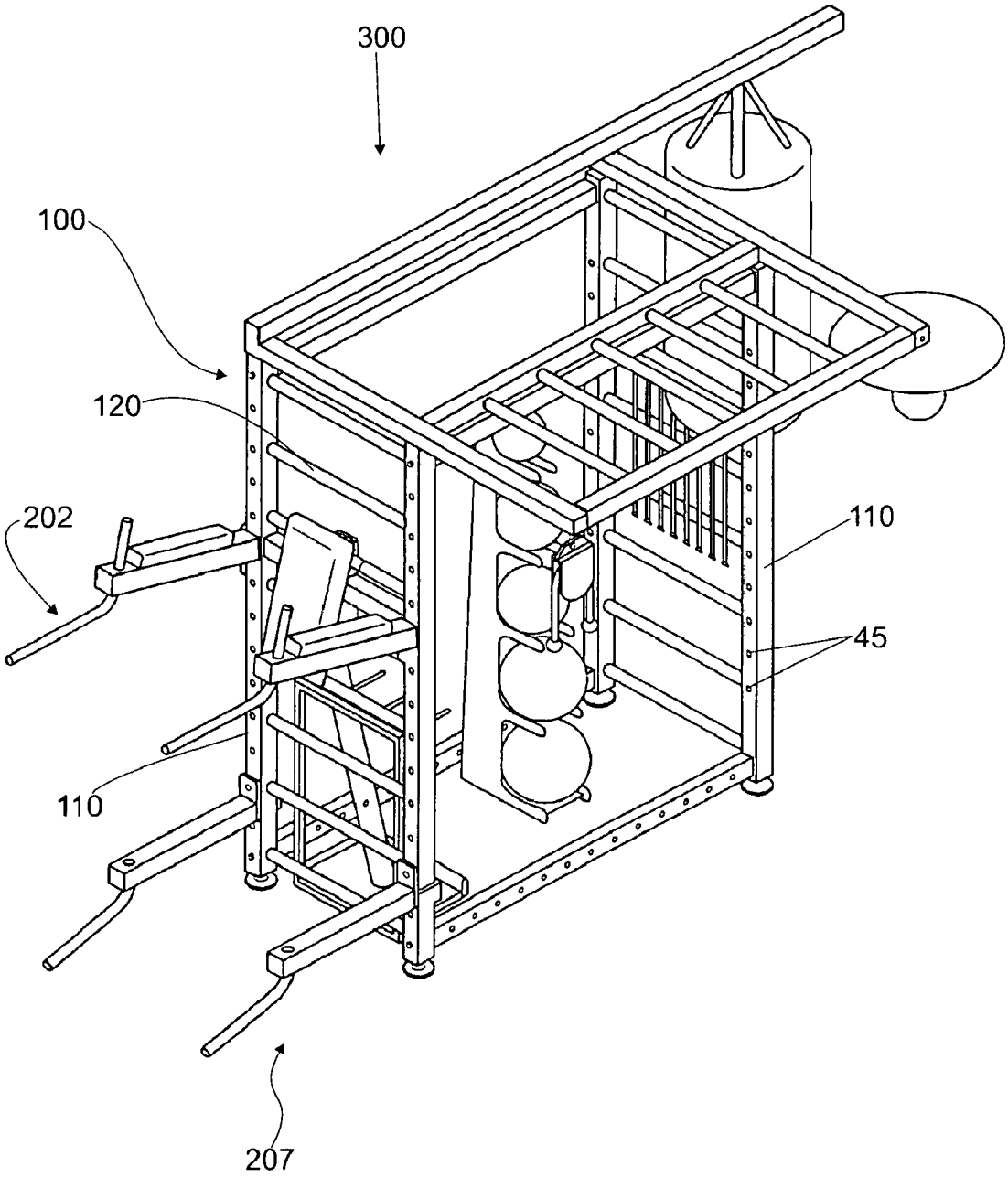
FIG.2 (PRIOR ART)
FIG. 2 (Prior Art) is a perspective view of a supporting cell 300 assembled by using the ladder-like structures 100 with various exercise devices (202, 207) attached thereto.
Figure 3A:
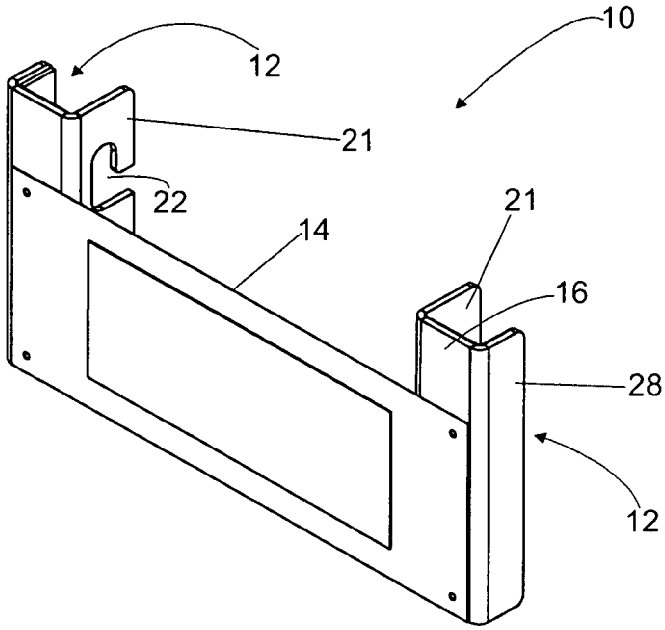
FIG. 3*a* illustrates a mounting apparatus 10 for mounting an exercise device (not shown)

FIG. 3*a* illustrates a mounting apparatus 10 for mounting an exercise device 200 to the members (110 and 120) of the ladder-like structure 100. The apparatus 10 comprises at least two mounting brackets 12 which are connected in parallel in spaced apart relationship to each other by a connecting member 14. The connecting member 14 is a rectangular shaped connecting plate attached to the front side 16 of the mounting bracket 12. The mounting brackets 12 are preferably placed adjacent to each vertical support member 110 of the ladder-like structure 200. The mounting brackets 12 have a U-shaped profile thereby allowing it to embrace the rectangular profile of three sides of the vertical support member 110 of the ladder-like structure 100.

Figure 3B:
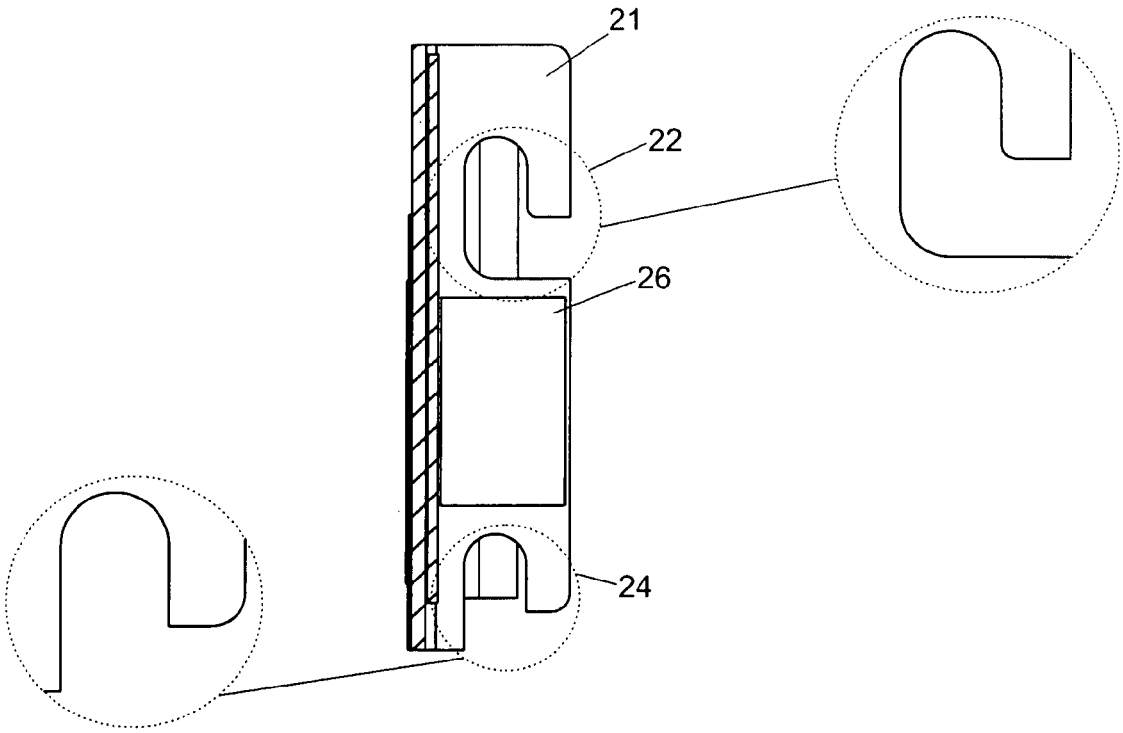
FIG. 3*b* illustrates the inner side 21 of a mounting bracket 12 of the mounting apparatus 10.

FIG. 3*b* illustrates the inner side 21 of the mounting bracket 12 having at least one substantially L-shaped slot 22 and a slot 24 extending vertically upward from the end of the bracket 12 for receiving the rung 120 of the ladder-like structure 100 so as to attach the bracket 12 to the ladder-like structure 100. In an alternate design both the slots (22 and 24) in a mounting bracket 12 are substantially L-shaped. Various other types of slots can also be used without altering the scope of the invention. The inner side 21 is further provided with wear pads 26 to impart wear resistance.

Figure 3C:
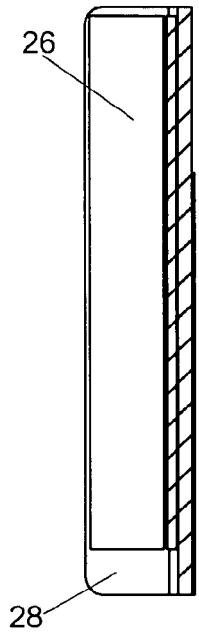
FIG. 3*c* illustrates the outer side 28 of the mounting bracket 12 of the mounting apparatus 10.

FIG. 3*c* illustrates the outer side 28 of the mounting bracket 12 that helps to embrace the vertical, elongate support member 110 of the ladder-like structure 100. The outer side 28 is also provided with wear pads 26 to impart wear resistance.

Figure 3D:
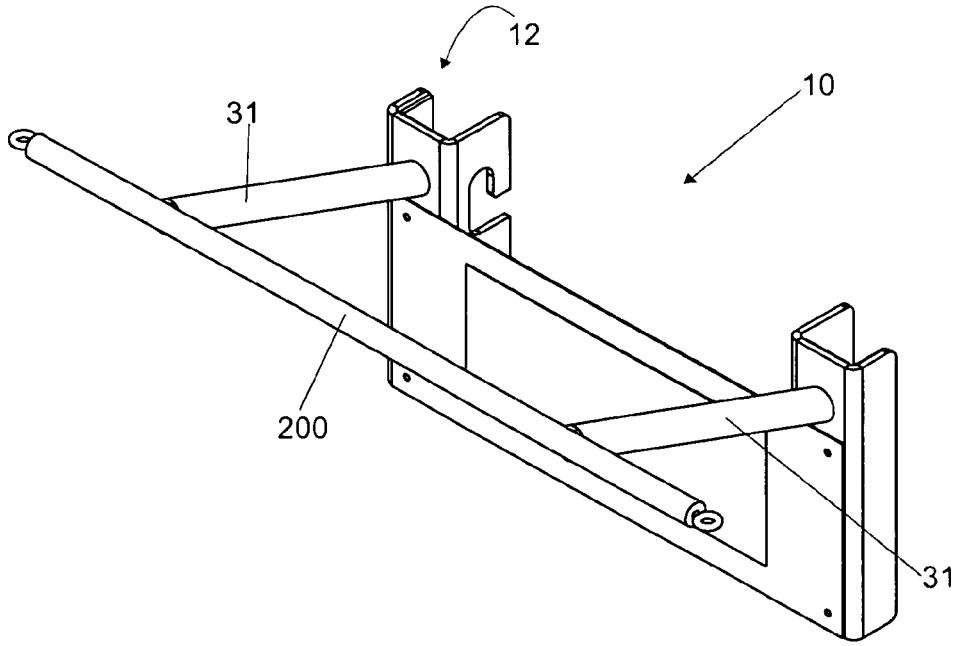
FIG. 3*d* shows an isometric view of the mounting apparatus 10 having horizontal bars 31 for mounting an exercise device 200.

FIG. 3*d* illustrates front view of the mounting apparatus 10 onto which horizontal bars 31 have been attached for mounting the exercise device 200.

Figure 4A:
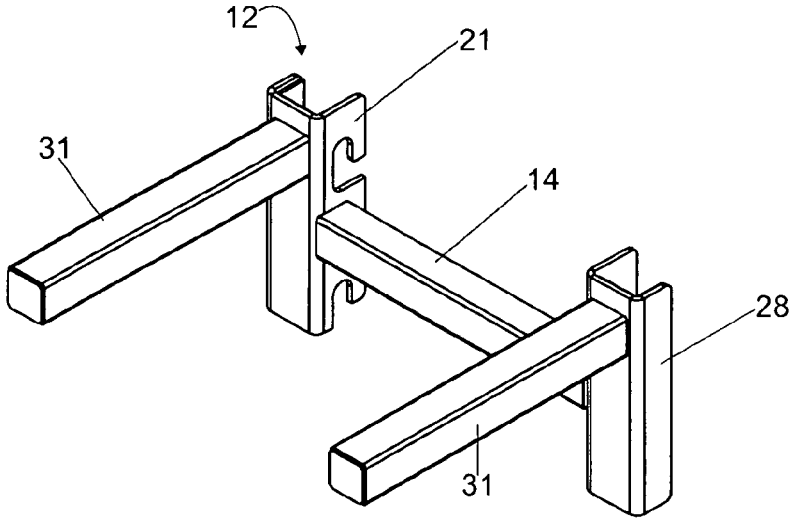
FIG. 4*a* illustrates an alternate configuration of the connecting member 14 of the mounting apparatus 10.

In an alternate embodiment of the present invention, the connecting member 14 is a horizontal bar attached to the inner sides 21 of the mounting brackets 12 as illustrated in FIG. 4*a*.

The connecting members 14 can be of various sizes and shapes and in multiple numbers for connecting at least two mounting bracket 12 without altering the scope of the present invention.

Figure 4B:
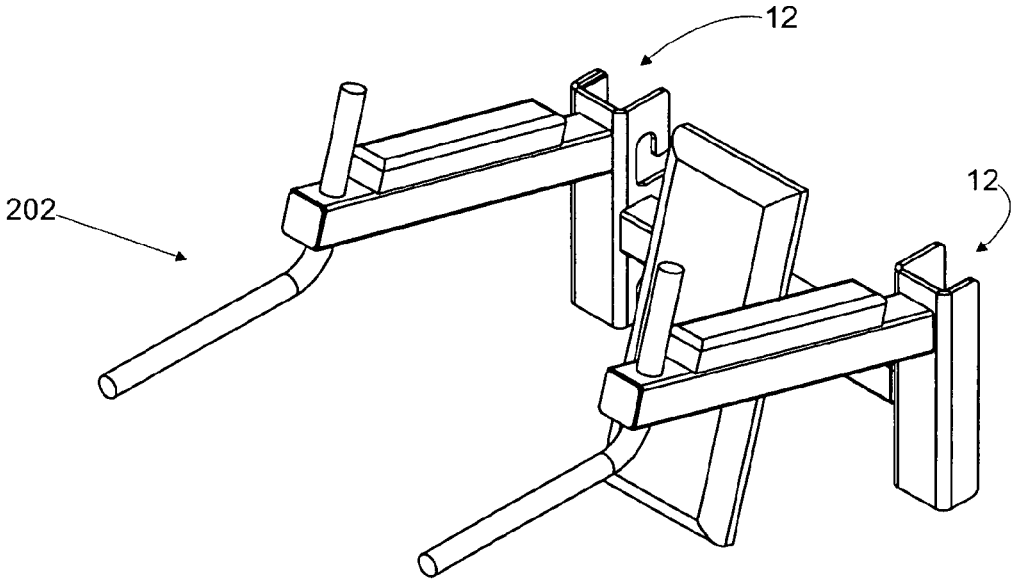
FIG. 4*b* illustrates the attachment of a dipping station 202 to the mounting apparatus 10.
Figure 4C:
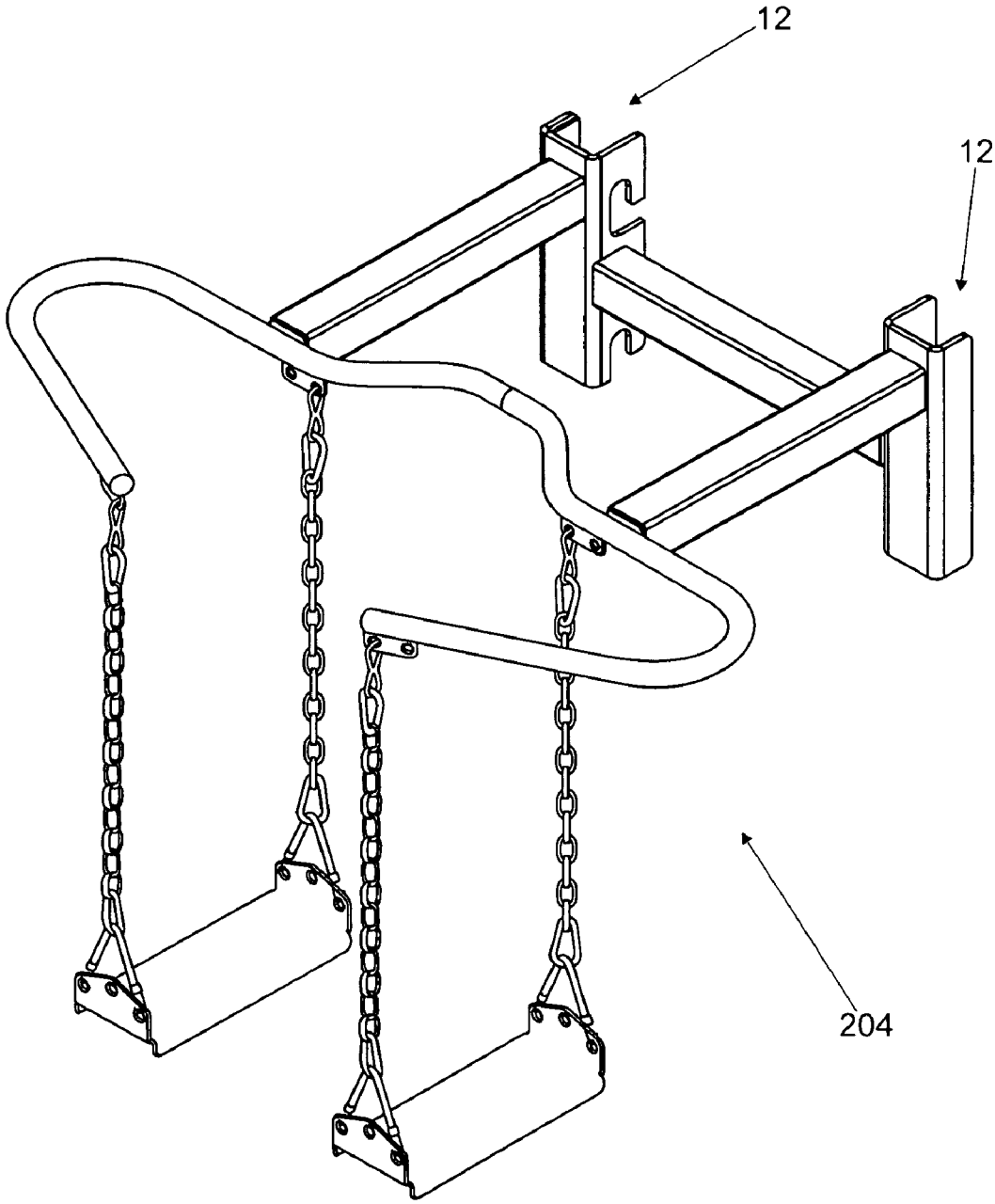
FIG. 4*c* illustrates the attachment of a strider assembly 204 to the mounting apparatus 10.

Further, various types of exercise devices 200, such as the "dipping station" 202 as shown in FIG. 4*b* or the "strider assembly" 204 as shown in FIG. 4*c*, can be mounted to the mounting apparatus 10 without altering the scope of the present invention.

Figure 5A:
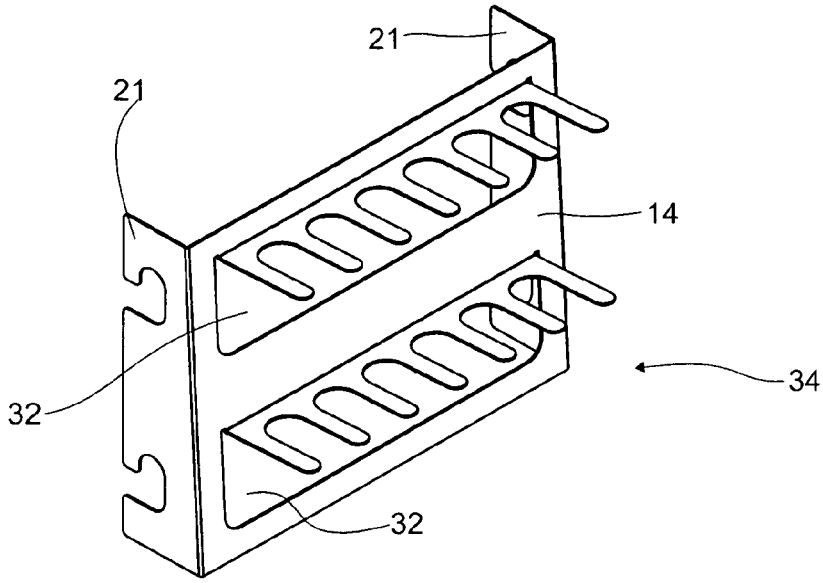
FIG. 5*a* illustrates an alternate configuration of the mounting bracket 12 with clamp rack attached thereto to form a bar storage rack 32.

In another embodiment of the present invention, the mounting bracket 21 is a rectangular plate as shown in FIG. 5*a*. The mounting bracket 21 has at least two substantially L-shaped slots 22 for receiving the rungs 120 of the ladder-like structure 100 so as to attach the bracket 21 to the ladder-like structure 100. The mounting brackets 21 are connected in parallel in spaced apart relationship to each other by a connecting member 14 such as a plate. Various types of exercise accessories can be attached to the connecting member 14 of the mounting bracket 21. For example, clamp racks 32 can be attached to the connecting member 14 of the mounting bracket 21 to act as a bar storage rack 34 as shown in the figure.

Figure 5B:
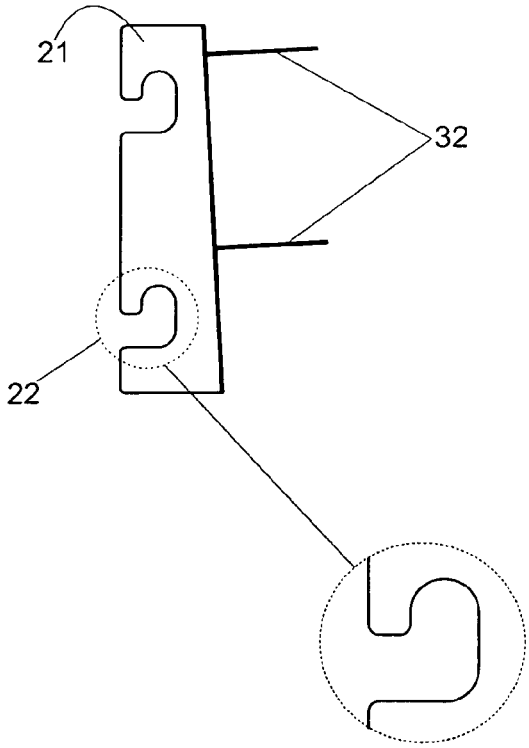
FIG. 5*b* shows a side view of the bar storage rack 32.

FIG. 5*b* illustrates side view of the bar storage rack 34 and enlarged view of the substantially L-shaped slot 22.

Figure 6A:
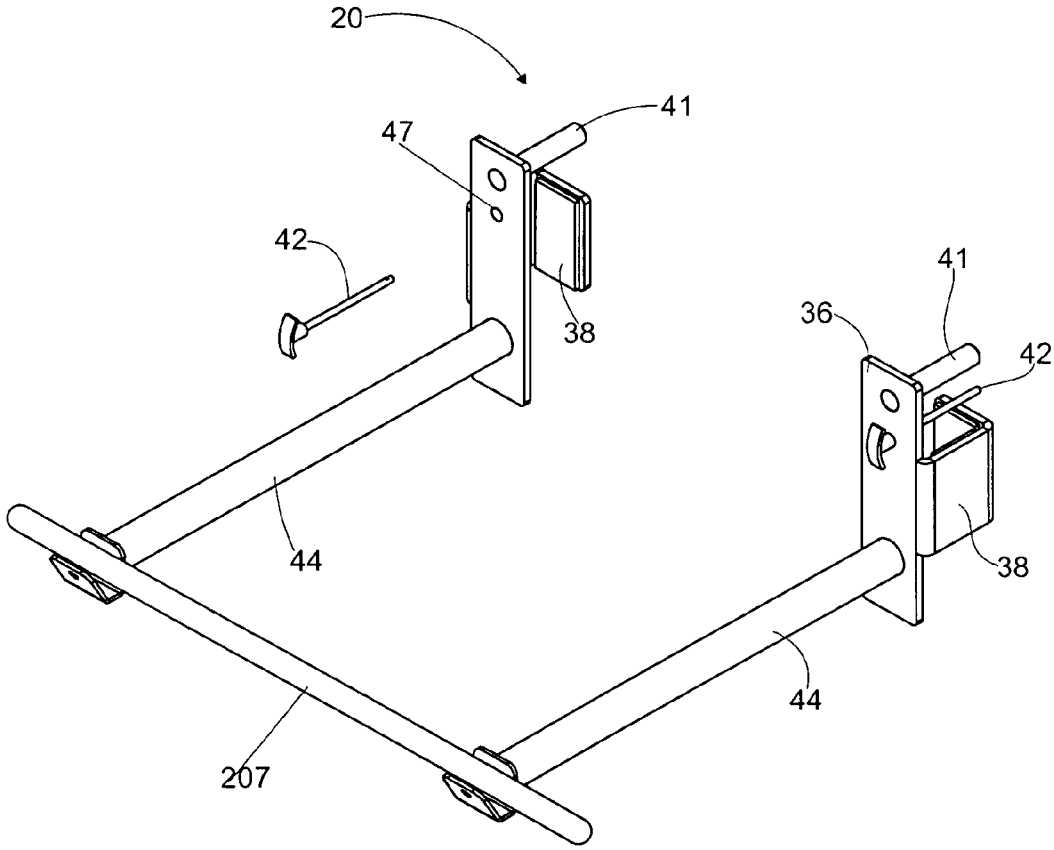
FIG. 6*a* illustrates another type of mounting apparatus 20 comprising two bars 44 that form a dipping station, each with a V-groove at the end for mounting an exercise device (pull-up assembly 207 shown)

FIG. 6*a* illustrates another type of mounting bracket 20 for mounting an exercise bar 207 to the members 110 of the ladder-like structure 100. The mounting brackets 20 are placed on the vertical, elongate support members 110 of the ladder-like structure 100. The mounting bracket 20 has a mounting plate 36, at least one L or C-shaped gripping plate 38, at least one mounting pin 41, at least one locking pin 42 and at least one horizontal bar 44 as shown in the figure.

The L or C-shaped gripping plate 38 is attached to the mounting plate 36 to form a U-shaped profile adapted to embrace the vertical support member 110. The mounting pin 41 is fixedly attached to the mounting plate 36 and is adapted to be inserted into one of the larger holes 45 in the vertical support member 110 for attaching the mounting plate 36 to the vertical support member 110. The locking pin 42 is adapted to be inserted in a hole 47 in the mounting plate 36 and into one of the smaller holes 46 in the vertical support member 110 for preventing rotation of the mounting plate 36 about the principal mounting pin 41 when attached to the vertical support member 110. The mounting pin 41 and the hole 47 in the mounting plate 36 for engaging the locking pin 42 are positioned at a pre-determined distance from each other. The pre-determined distance is preferably about two inches on center, which is the same as the distance between the holes 45 and 46 in the vertical, elongate support members 110 of the ladder-like structure 100, thereby enabling the mounting brackets 20 to be attachable to any supporting structure such as the ladder-like structure 100. The horizontal parallel bars 44 attached to the mounting plates 36 serve as a dipping station for the user and include V-grooves at their ends for supporting an exercise device, such as the exercise bar 207. The mounting bracket 20 further includes wear pads at the inner side of the gripping plate 38 to provide a snug fit.

The mounting plate 36 shown in the figure is a rectangular plate and the horizontal bracket 44 attached to the mounting plate 36 is a bar or rod like structure, whereas other types of mounting plates and horizontal brackets of various shapes and sizes can also be used without altering the scope of the invention.

Figure 6B:
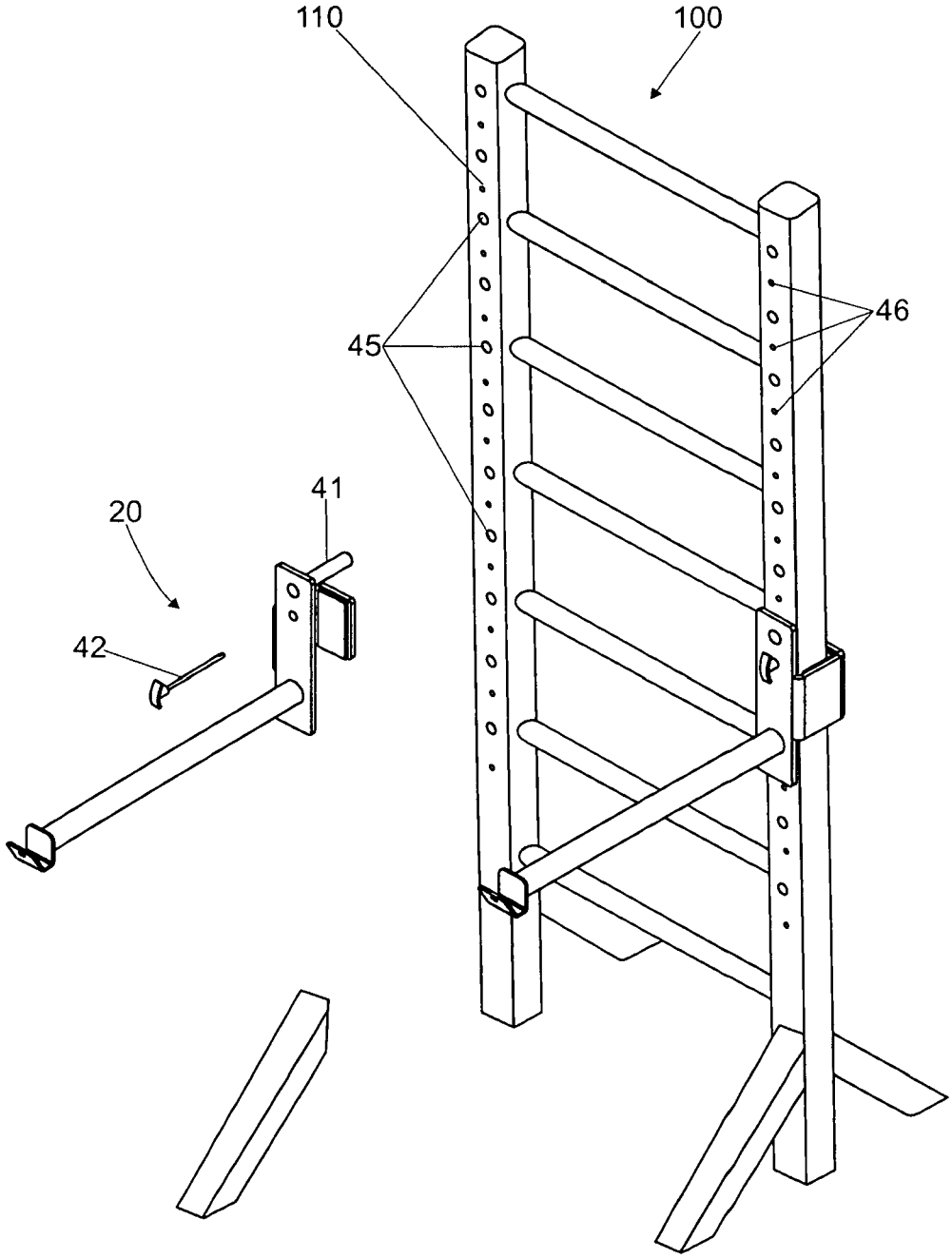
FIG. 6*b* illustrates the attachment of the mounting apparatus 20 to the vertical, elongated support members 110 of the ladder-like structure 100.

FIG. 6*b* illustrates the attachment of the mounting apparatus 20 to the vertical, elongated support members 110 of the ladder-like structure 100. The vertical support members 110 and the matching bracket 38 can have a rectangular profile, as shown, or a round profile, oval profile or any other desired profile.

Figure 7A:
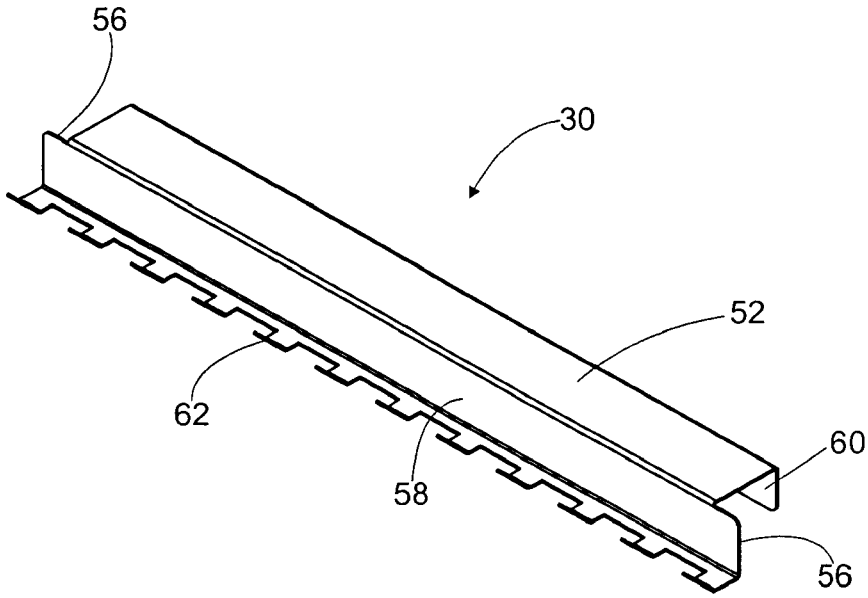
FIG. 7*a* illustrates another type of mounting apparatus 30 for mounting exercise accessories.

FIG. 7*a* illustrates another type of mounting apparatus 30 for mounting exercise accessories to the members 120 of the ladder-like structure 100. The mounting apparatus 30 has an elongate bracket 30 having a U-shaped profile. Center portion 52 of the bracket 30 is adapted to surround one of the horizontal rungs 120 of the ladder-like structure 100 when mounted thereon. At least one end portion of the bracket 30 extends 56 outward beyond the length of the rung 120 to overlap one of the vertical support members 110 thereby preventing rotation of the bracket 30 about the rung 120 of the ladder-like structure 100.

The front face 58 of the elongated bracket 30 has a plurality of spaced projections 62 for attaching exercise accessories, such as elastic bands.

Figure 7B:
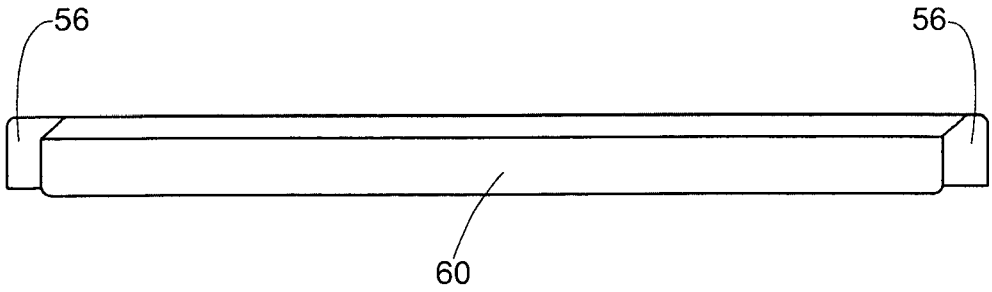
FIG. 7*b* shows a rear view of the mounting apparatus 30.

FIG. 7*b* is a rear view of the mounting bracket 30. Clearly visible are the extensions 56 on either side of the bracket that press against the vertical support members 110 when the bracket is installed on a rung 120 of the ladder-like structure.

Figure 7C:
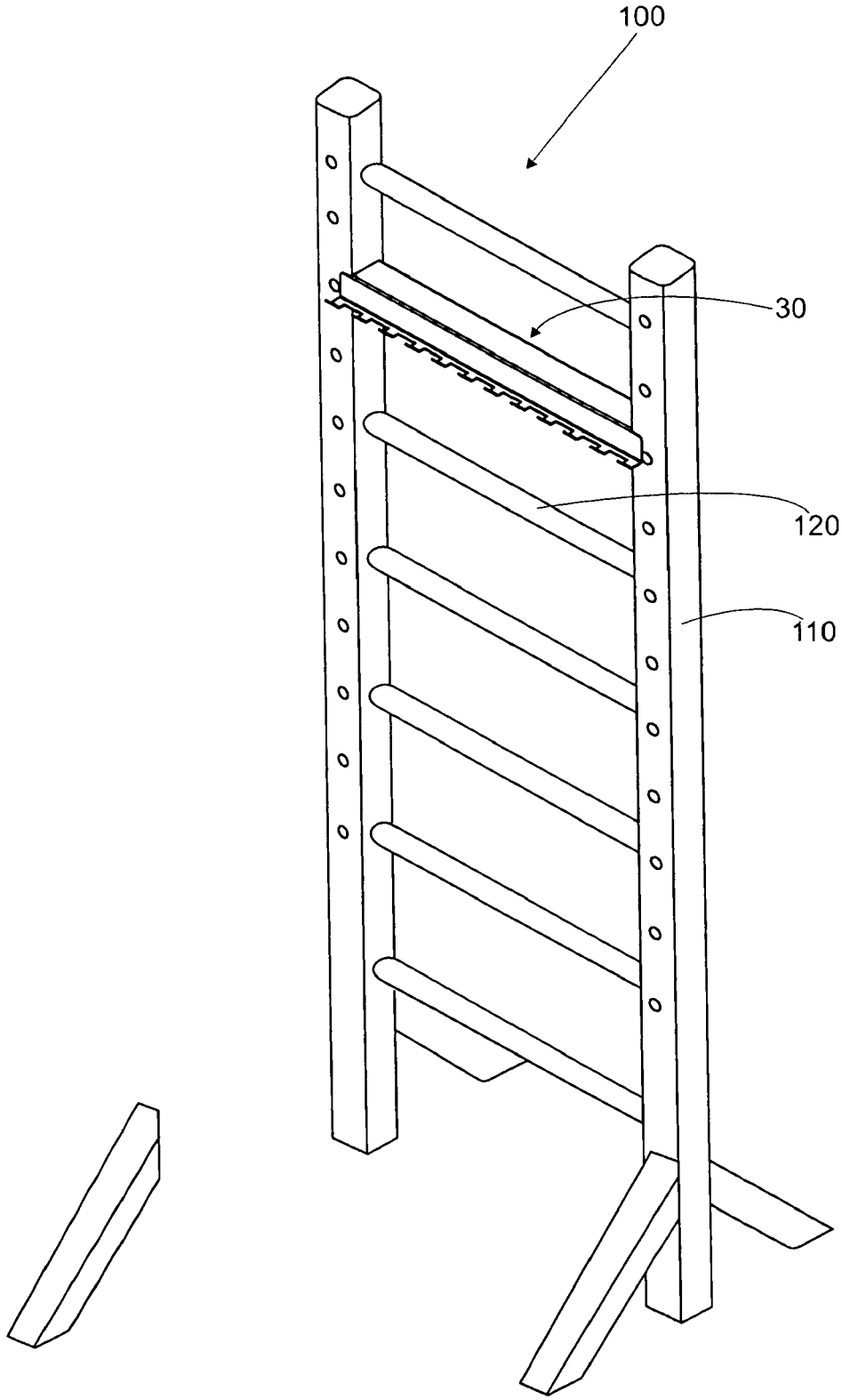
FIG. 7*c* illustrates the attachment of the mounting apparatus 30 to the horizontal rung 120 of the ladder-like structure 100.

FIG. 7*c* illustrates the attachment of the mounting apparatus 30 to a horizontal rung 120 of the ladder-like structure 100.

While embodiments of the present invention have been illustrated and described, it will be clear that the present invention is not limited to these embodiments only. Numerous modifications, changes, variations, substitutions and equivalents will be apparent to those skilled in the art, without departing from the spirit and scope of the present invention, as described in the following claims.

What is claimed is:

1. An apparatus for mounting an exercise device to at least one vertical, elongate support member having a substantially rectangular profile and having a substantially planar surface on one longitudinal side thereof with a plurality of holes therein successively separated by a predetermined distance along its length, said apparatus comprising:

a) a mounting bracket, which can be removably attached to said surface of said support member, said bracket comprising:

I. a substantially planar mounting plate adapted to be attached to said support member, said mounting plate having two opposite side edges;

II. at least one gripping plate having an L-shaped profile and attached to one of said side edges of said mounting plate, thereby to form a U-shaped profile adapted to embrace three sides of said rectangular profile of said support member;

III. at least one mounting pin fixedly attached to said mounting plate and adapted to be inserted in one of said holes in said surface of said support member for attaching said mounting plate to said support member; and IV. at least one locking pin adapted to be inserted in a hole in said mounting plate and in another one said holes in said surface of said support member for preventing rotation of said mounting plate when attached to said support member; and b) a bracket affixed to said mounting plate for supporting an exercise device.

2. The mounting apparatus defined in claim 1, wherein said mounting plate is a substantially rectangular plate in plan view.

3. The mounting apparatus defined in claim 1, wherein said gripping plate is provided with at least one wear pad to impart wear resistance.

4. The mounting apparatus defined in claim 1, wherein said mounting pin and said hole for engaging said locking pin are separated from each other by said predetermined distance.

5. The mounting apparatus defined in claim 1, wherein said mounting pin has a larger diameter than said locking pin.

6. The mounting apparatus defined in claim 1, wherein said bracket affixed to said mounting plate is a bar or rod-line structure.

* * * * *